United States Patent [19]

Bunin

[11] 3,981,097

[45] Sept. 21, 1976

[54] ANIMATED FIGURE

[76] Inventor: Morey Bunin, 140 Riverside Drive, New York, N.Y. 10024

[22] Filed: May 30, 1975

[21] Appl. No.: 582,420

[52] U.S. Cl. ..... 46/126; 46/135 R

[51] Int. Cl.[2] ..... A63H 7/00

[58] Field of Search ..... 46/126, 135 R, 115; 40/106.41, 106.43

[56] References Cited

UNITED STATES PATENTS

| | | | |
|---|---|---|---|
| 3,070,290 | 1/1963 | Bunin | 46/126 |
| 3,691,676 | 9/1972 | Mellow | 46/126 |

*Primary Examiner*—Jack Q. Lever

[57] ABSTRACT

Animated caricature for television and the like including an elastic body outline and attached head outline with arms, legs and feet, the feet being adhered to an invisible stationary background and the head outline being attached at the top only to a movable invisible outline containing the representation of a face. By moving the movable background member relative to said stationary member various facial and body distortional movements can be portrayed. Additionally the arms are capable of separate articulation to provide additional distortional movements and expressions.

7 Claims, 9 Drawing Figures

15
61
60
52
63
62
51
53
54
56
58
59
57
55
12
25
28
30
23

ANIMATED FIGURE

BACKGROUND OF THE INVENTION

In recent years sophistication of television programming techniques has resulted in increasing use of puppets and two-dimensional caricatures with the increased need for more life-like simulation as well as simplicity of operation of the apparatus involved. Representative of past efforts are U.S. Pat. No. 3,070,920 (by the present inventor) and U.S. Pat. No. 3,691,676, both of which relate to two-dimensional animated characters particularly adapted for television.

The present invention is an improvement on the inventor's prior patent identified above, in that it makes possible the attainment of a more nearly life-like animated character with a greater variety of movements and expressions while at the same time optimizing on the control mechanisms required. Another important improvement on the inventor's prior patent is that the present invention makes it possible to place the character over a background without the background being visible through the facial area.

BRIEF DESCRIPTION OF THE INVENTION

The present invention involves animated character apparatus adapted especially for television transmission comprising a flat neutral or invisible stationary background surface member having a caricature body form mounted on said surface which includes an elastic body outline including arms and feet and an attached elastic head outline portion. The body outline is adhered to the stationary background surface member only at the feet while being otherwise movable relative thereto. The head outline portion is attached to a flat movable background member only at the upper portion thereof. The movable member carries on it a face representation including eyebrows, eyes and a pliable mouth portion. The movable member is shiftable to provide facial and body distortional movement of the caricature and separate control means are included to articulate the eyebrows, eyes, mouth and arms.

Other objects and features of the invention will become apparent in the following description.

DESCRIPTION OF THE DRAWINGS

FIG. 3 is a schematic representation of the caricature body form showing lateral distortion thereof;

DESCRIPTION OF THE PREFERRED EMBODIMENT

Figure 1:
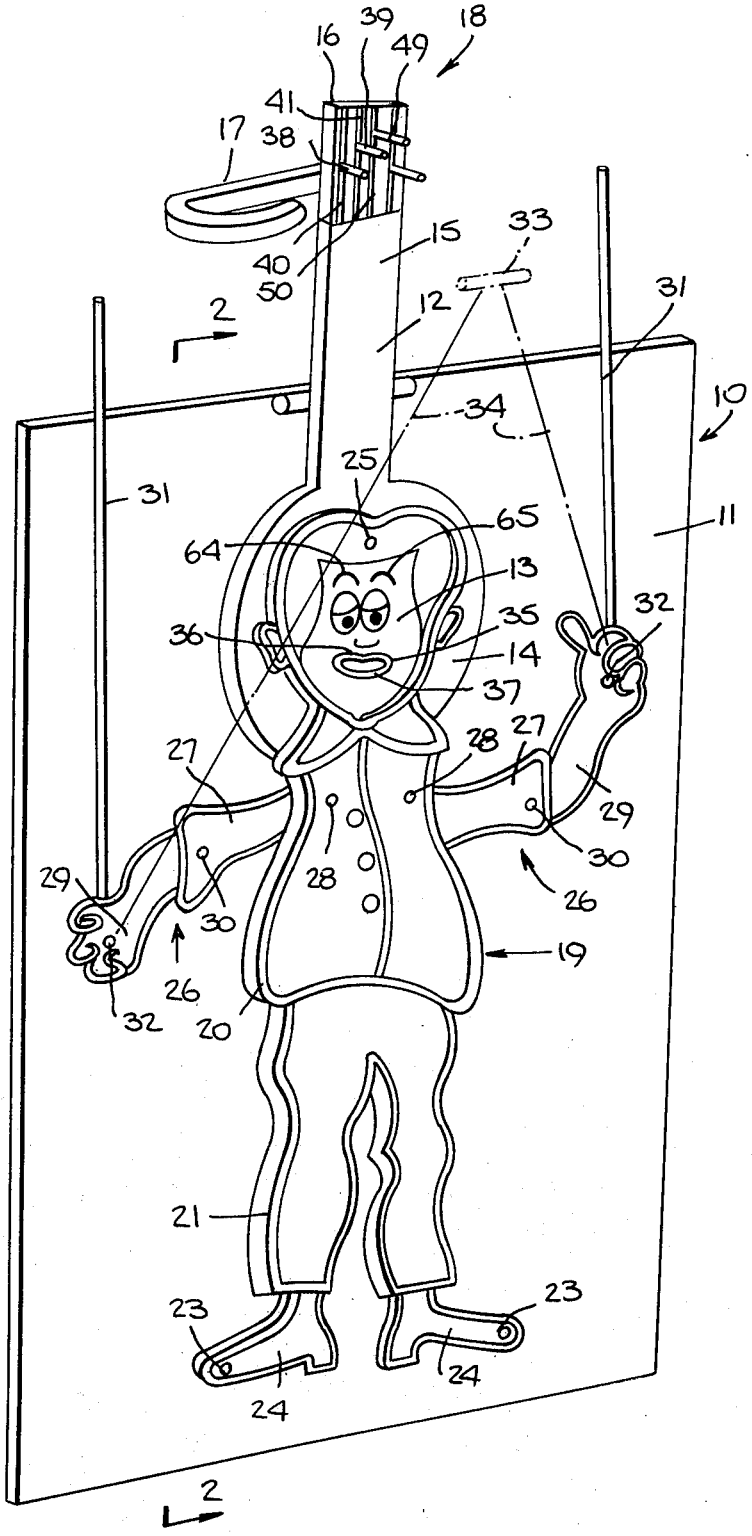
FIG. 1 is an isometric view of animated caricature apparatus according to the present invention.
Figure 2:
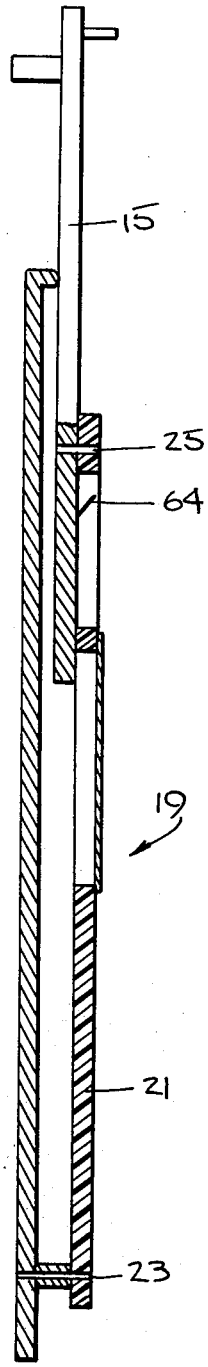
FIG. 2 is a section taken along lines 2—2 of FIG. 1.

Referring now to the drawings apparatus according to the principles of the present invention is shown and designated generally by reference numeral 10. Included in the apparatus is a flat neutral stationary background surface member 11 which conventionally is fabricated from plywood or the like covered with a black or otherwise invisible cloth when presented on television. Disposed adjacent the stationary background member 11 is a flat movable background member 12 having a face representation 13 thereon at a lower enlarged portion thereof and an upper vertical extension 15 carrying near the top 16 handle member 17 and control members 18 to be described hereinafter. A caricature body form 19 of an elastic pliable material such as foam rubber, polyurethane foam, et cetera including body outline 20, legs 21 and head outline 22, all either integrally formed or attached to one another is mounted by suitable means such as nails 23 or the like at feet 24 to stationary member 11, this being the only connection of the caricature body form to the stationary member 11. The head outline portion 22 is affixed to the movable member 12 only by means of a fastener such as a nail or the like 25.

Figure 4:
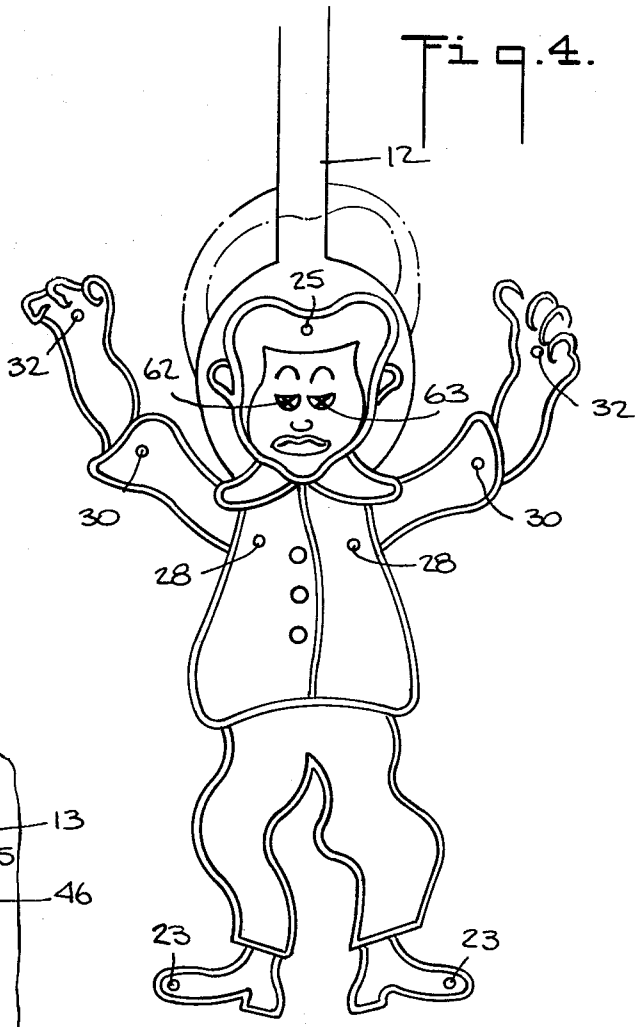
FIG. 4 is a schematic representation of the caricature body form showing downward vertical distortion thereof.
Figure 5:
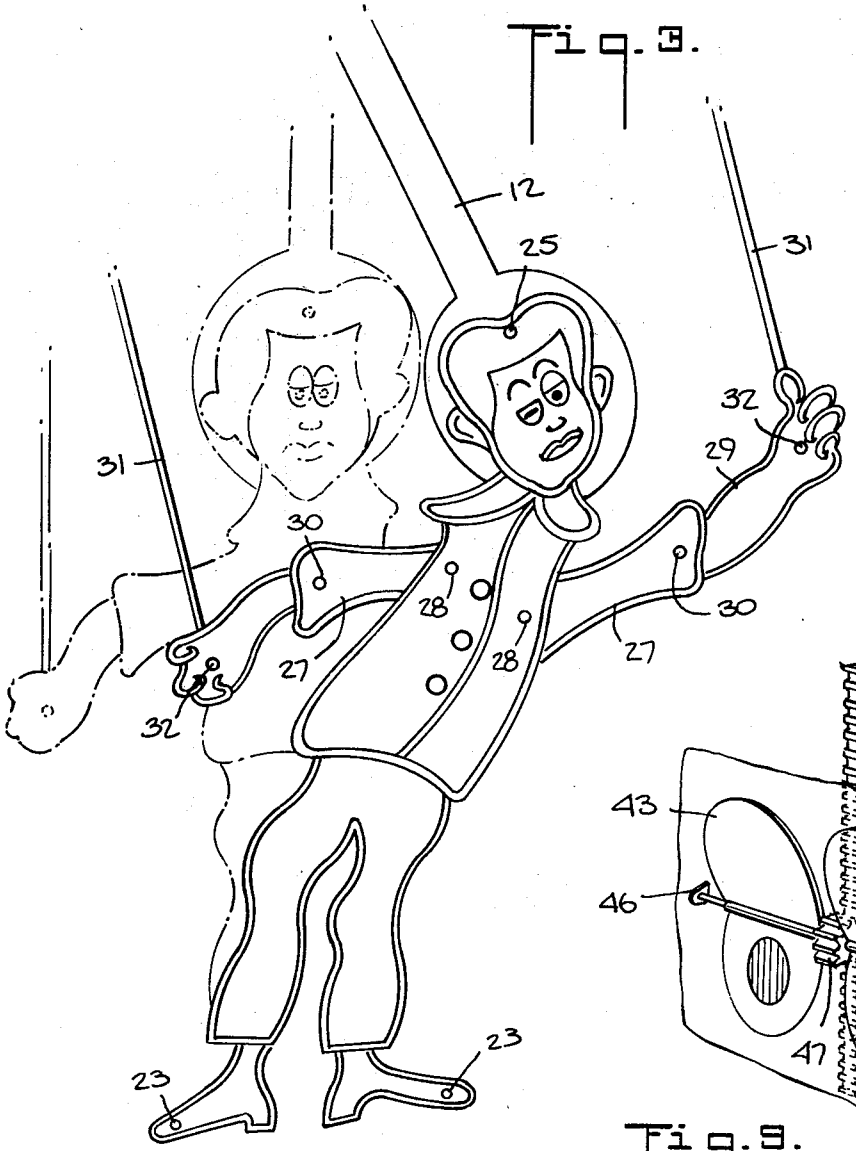
FIG. 5 is a schematic representation of the caricature body form showing upward vertical distortion thereof.

Arm members 26 are disposed on either side of the body form 19 and are comprised of flat members which may be fabricated from cardboard, plastic or other sheet material and include upper arm members 27 which are pivotally attached by any conventional means 28 to the body outline 20 and forearm members 29 which are pivotally attached by pin members or other conventional fasteners 30 to upper arm members 27. Respective control means 31 such as rods shown are pivotally attached by pins 32 or the like to the extremities of forearms 29 to provide articulation of the arms 26 with subsequent distortion of the caricature body form 19 as shown in FIGS. 3, 4 and 5. Alternatively arm members 26 can be controlled from a single manual handle 33 attached to control wires or strings 34 attached to respective arm members 26 as shown in dotted lines in FIG. 1.

In the face portion 13 on movable member 14 is deformable mouth 35 of rubber or the like having separately controlled upper lip 36 and lower lip 37 attached to control pins 38 and 39 respectively at the top of extension 12 by means of suitable respective control rods 40 and 41. All portions of movable member 14 are rendered invisible for television by being covered with suitable material such as black cloth or the like except for the face portion 13 located within head outline 22.

Figure 9:
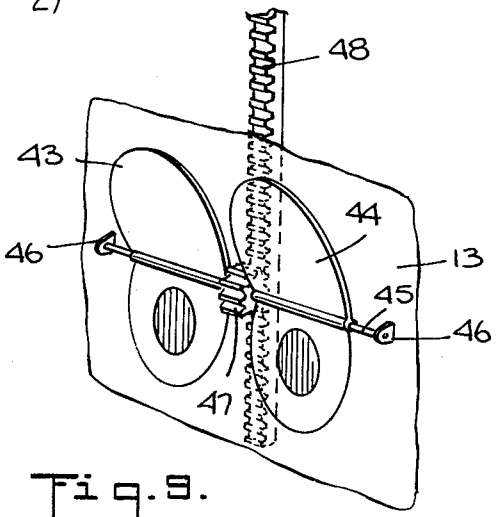
FIG. 9 shows one mechanism for articulating the eyes.
Figures 5, 6, 7, 8:
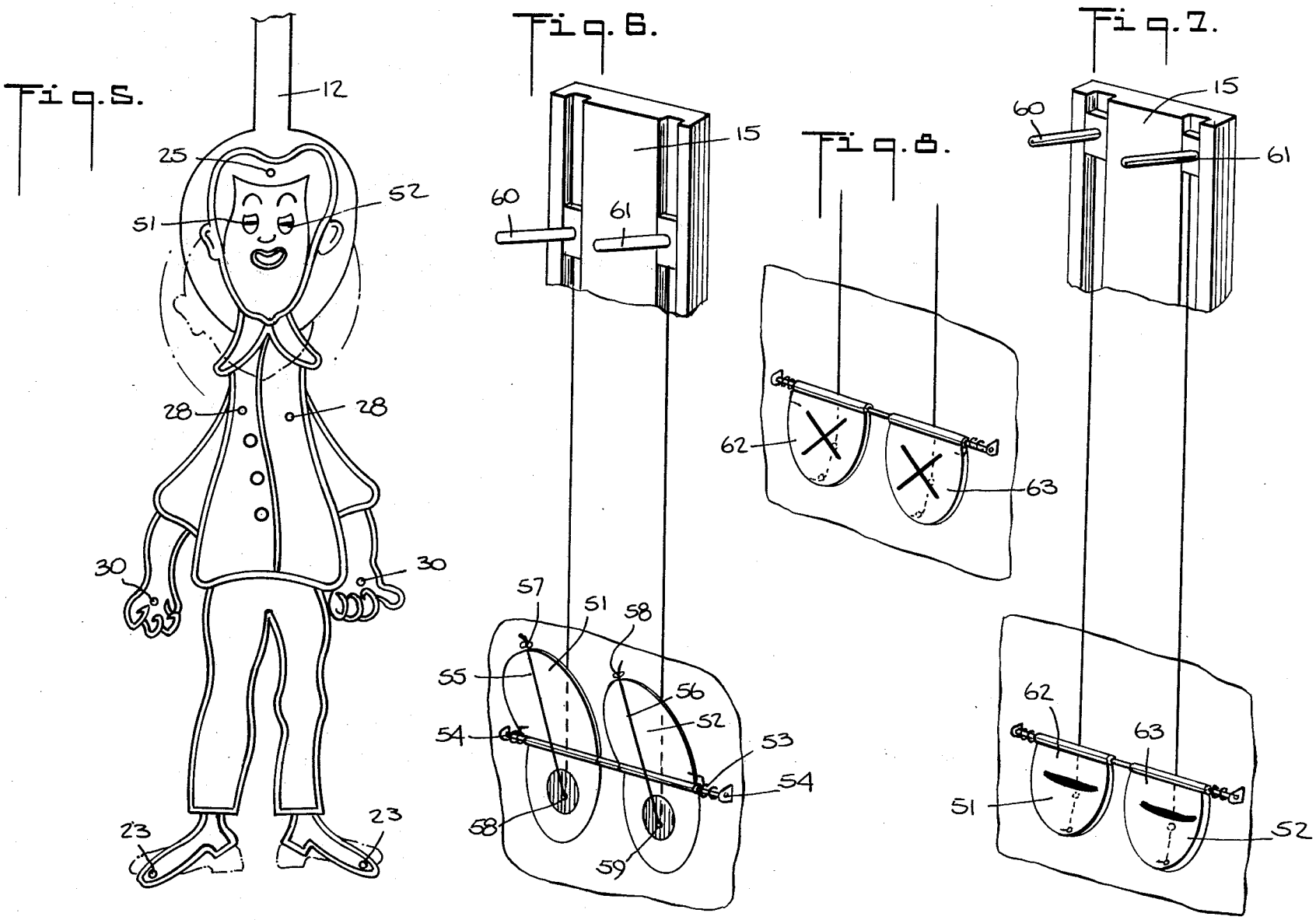
FIG. 6 is a schematic representation of one embodiment of the eye control mechanism.
FIG. 7 is a representation of the eye control mechanism of FIG. 6 in another position.
FIG. 8 shows the mechanism of FIG. 7 with a different ocular representation thereon.

Eyes 42 may be simultaneously controlled as shown by the mechanism in FIG. 9 or individually controlled by a mechanism such as shown in FIGS. 6–8. The FIG. 9 control means effects simultaneous control of pivotally mounted flaps 43 and 44 mounted on shaft 45 affixed at its ends by means of brackets 46 to face portion 13.

Pinion 47 mounted on shaft 45 between flaps 43,44 engages rack 48 vertically movable in an up and down direction which permits the flaps 43,44 to be in the open position as shown in FIG. 9 or in a down position similar to that shown for the other embodiment in FIGS. 7 and 8, permitting one eye expression to be displayed on surface 13 and another expression to be displayed when flaps 43,44 are in the closed position such as shown in FIG. 4. Rack 48 would be connected to control pin 49 by means of rod member 50 (see FIG. 1).

The alternate eye control mechanism as shown in FIGS. 6-7 would have pivotal flaps 51,52 mounted for vertical pivotal movement on shaft 53 affixed to face portion 13 by brackets 54. Wires or strings 55,56 are connected at lower ends 57,58 to flaps 51,52 and extend through holes 58,59 and upwardly to control pins 60,61 on extension 12 from lower positions as shown in FIG. 6, where the flaps are in an open position to an upper position as shown in FIG. 7 where the flaps are in a down or closed position. In the latter position different eye representations can be placed on the exposed portions 62,63 or flaps 51,52 (see also FIG. 8).

Similar control means can be utilized to move the eyebrow members 64,65 vertically upward and downward.

It can be seen from the above description that various movements of the body, face and arms can be achieved as well as various facial expressions including eyebrows, eyes and lips to simulate human mannerisms. The versatility of this apparatus greatly exceeds that of any prior art device.

While certain embodiments of the invention have been shown and described herein it is to be understood that changes and additions may be made by those skilled in the art without departing from the scope and spirit of the invention.

I claim:

1. Animated caricature apparatus for television transmission and the like comprising a flat neutral stationary background surface member, a caricature body form mounted on said surface including an elastic body outline including arms and feet and an integrally formed elastic head outline portion, said body outline adhered only at said feet to said background surface while being otherwise movable relative thereto, a flat movable background member having a face representation thereon including eyes and slideably movable relative to said stationary member, said movable member carrying said head outline portion affixed thereto at only the upper portion thereof and being shiftable with respect to the lower portion thereof to provide facial and body distortional movement of said caricature.

2. Animated caricature apparatus for television transmission and the like comprising a flat neutral stationary background surface member, a caricature body form mounted on said surface including an elastic body outline including arms and feet and an integrally formed pliable head outline portion, said body outline adhered only at said feet to said background surface while being otherwise movable relative thereto, a flat movable background member having a face representation thereon including eyes and slideably movable relative to said stationary member, said movable member carrying said head outline portion affixed thereto at only the upper portion thereof and being shiftable with respect to the lower portion thereof to provide facial and body distortional movement of said caricature, and separate means affixed to said face portion to articulate the eyes.

3. Animated caricature apparatus for television transmission and the like comprising a flat neutral stationary background surface member, a caricature body form mounted on said surface including an elastic body outline including arms and feet and an integrally formed pliable head outline portion, said body outline adhered only at said feet to said background surface while being otherwise movable relative thereto, a flat movable background member having a face representation thereon including eyes and slideably movable relative to said stationary member, said movable member carrying said head outline portion affixed thereto at only the upper portion thereof and being movable with respect to the lower portion thereof to provide facial and body distortional movement of said caricature, separate means affixed to said face portion to articulate the eyes, and a pliable mouth portion on said face representation and having independent means to articulate the upper and lower portions thereof.

4. Animated caricature apparatus for television transmission and the like comprising a flat neutral stationary background surface member, a caricature body form mounted on said surface including an elastic body outline including arms and feet and integrally formed pliable head outline portion, said body outline adhered only at said feet to said background surface while being otherwise movable relative thereto, a flat movable background member having a face representation thereon including eyes and slideably movable relative to said stationary member, said member carrying said head outline portion affixed thereto at only the upper portion thereof and being shiftable with respect to the lower portion thereof to provide facial and body distortional movement of said caricature, separate means affixed to said face portion to articulate the eyes, a pliable mouth portion on said face representation and having independent means to articulate the upper and lower portions thereof and the eyebrows.

5. Animated caricature apparatus for television transmission and the like comprising a flat neutral stationary background surface member, a caricature body form mounted on said surface including an elastic foam rubber body outline including arms and feet and an integrally formed pliable foam rubber head outline portion, said body outline adhered only at said feet to said background surface while having limited lateral and vertical movement relative thereto, a flat movable background member having a face representation thereon including eyes and slideably movable relative to said stationary member, said movable member carrying said head outline portion affixed thereto at only the upper portion thereof and laterally and vertically shiftable with respect to the lower portion thereof to provide facial and body distortional movement of said caricature, separate means affixed to said face portion to articulate the eyes, a pliable mouth portion on said face representation and having independent means to articulate the upper and lower portions thereof and the eyebrows, pivotal arm members affixed to said body outline and laterally movable therewith, and means to articulate said arms.

6. Apparatus according to claim 5 in which said movable background member includes an upward extension carrying handle means for manually supporting said apparatus and for articulating said face representation relative to said head outline portion, said extension also carrying said means for articulating said eyebrows, eyes and said mouth.

7. In the apparatus of claim 2 said eyes each comprised of pivotal flap members attached to said face and reciprocally pivotal about a horizontal line extending across said eye representation from a normally open position, with the under surface of the flap visible, to a closed position with the other surface of the flap visible, each surface of said flap presenting a different eye representation.

* * * * *